US006144306A

United States Patent [19]

Huang

[11] Patent Number: 6,144,306

[45] Date of Patent: Nov. 7, 2000

[54] DOOR MAT HAVING SOUND GENERATING DEVICE

[76] Inventor: Chi Ming Huang, No. 7, Tu Ku North Raod, Nanzu Chu, Kaoshiung, Taiwan

[21] Appl. No.: 09/294,571

[22] Filed: Apr. 20, 1999

[51] Int. Cl.[7] ..... G08B 21/00

[52] U.S. Cl. ..... 340/665; 340/666; 340/384.1; 340/692

[58] Field of Search ..... 340/665, 666, 340/668, 384.1, 692, 540, 541, 328

[56] References Cited

U.S. PATENT DOCUMENTS

| | | | |
|---|---|---|---|
| 3,991,415 | 11/1976 | Baar, Sr. | 340/384.1 |
| 4,023,151 | 5/1977 | Markham | 340/384.1 |
| 4,245,219 | 1/1981 | Dempsey et al. | 340/541 |
| 4,924,214 | 5/1990 | Hill | 340/666 |
| 5,210,528 | 5/1993 | Schulman et al. | 340/666 |
| 5,264,824 | 11/1993 | Hour | 340/384.1 |

*Primary Examiner*—Nina Tong
*Attorney, Agent, or Firm*—Charles E. Baxley

[57] ABSTRACT

A door mat includes a mat element disposed on top of a base which includes a bottom portion for engaging with a supporting surface. A sound generating device is secured to the bottom of the base and includes a switch button extended downward for engaging with the supporting surface. A spring may bias the switch button away from the supporting surface for allowing the switch button of the sound generating device to be actuated and depressed to energize the sound generating device when the base is depressed toward the supporting surface against the spring.

6 Claims, 2 Drawing Sheets

DOOR MAT HAVING SOUND GENERATING DEVICE

BACKGROUND OF THE INVENTION

1. Field of the Invention

The present invention relates to a door mat, and more particularly to a door mat having a sound generating device for generating a welcoming word or the like.

2. Description of the Prior Art

Typical door mats may be used for cleaning the shoe soles of the people coming into the house. However, none of the door mats may generating a welcoming word when a guest visits the house.

The present invention has arisen to mitigate and/or obviate the afore-described disadvantages of the conventional door mats.

SUMMARY OF THE INVENTION

The primary objective of the present invention is to provide a door mat including a sound generating device for generating a welcoming word or the like.

In accordance with one aspect of the invention, there is provided a door mat comprising a base including a mat element provided thereon and including a bottom portion for engaging with a supporting surface, the base including a first end and a second end, a sound generating device secured to the bottom portion of the base and located close to the first end of the base, the sound generating device including a switch button extended therefrom for engaging with the supporting surface, and means for biasing the switch button away from the supporting surface, the switch button of the sound generating device being actuated and depressed to energize the sound generating device when the base is depressed toward the supporting surface against the biasing means.

The mat element includes a plate and a brush member secured on the plate, and means for securing the plate of the mat element to the base. The base includes an upper portion having a depression formed therein for receiving the plate of the mat element. The first end of the bottom portion of the base includes a recess formed therein for receiving the sound generating device.

The bottom portion of the base includes at least one ear extended therefrom, at least one pin slidably engaged through the ear and having a bottom end for engaging with the supporting surface, and means for biasing the bottom end of the pin to engage with the supporting surface and to elevate and to space the switch button of the sound generating device from the supporting surface. The pin includes a pad secured to the bottom end thereof and includes an upper end extended upward beyond the ear, and means for preventing the pin from being disengaged from the ear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
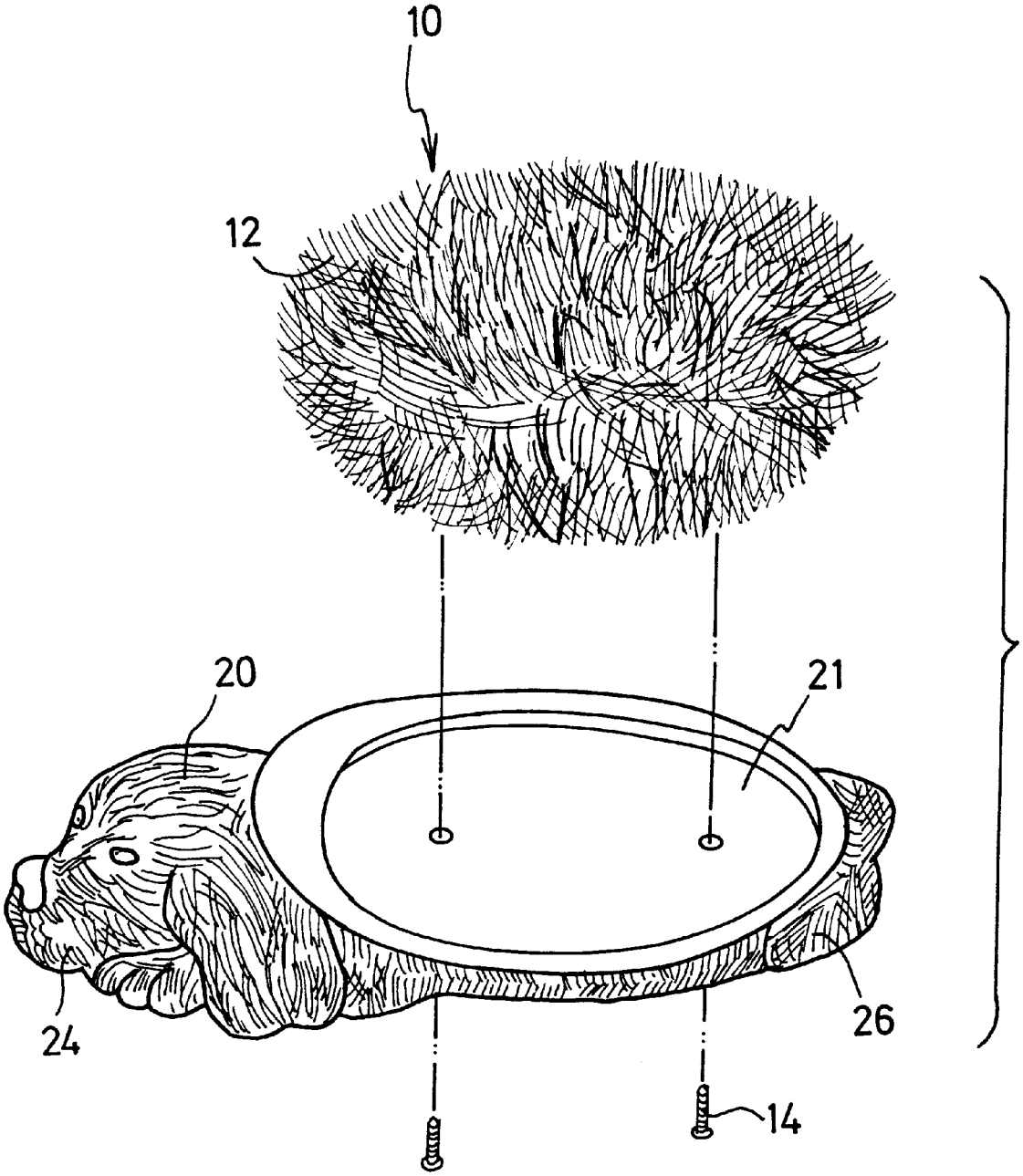
FIG. 1 is an exploded view of a door mat in accordance with the present invention.
Figure 2:
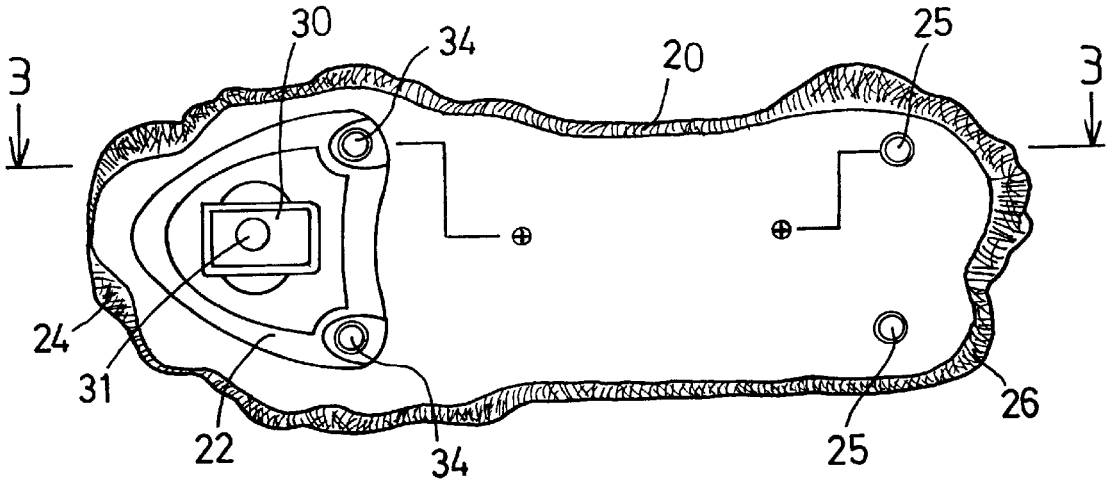
FIG. 2 is a bottom view of the door mat.
Figure 3:
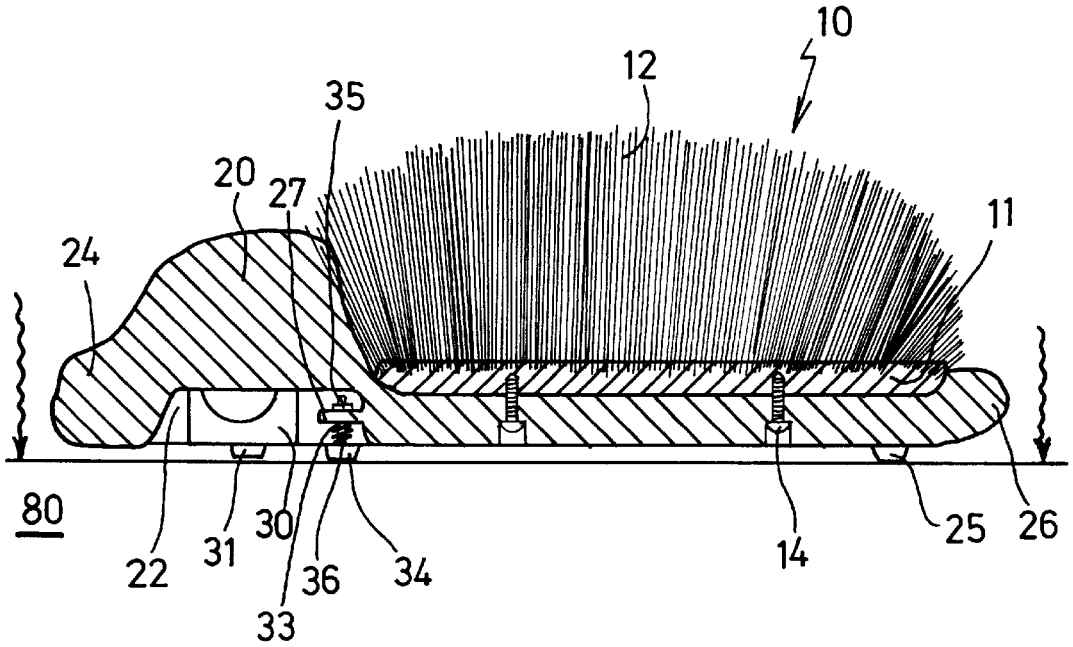
FIG. 3 is a cross sectional view taken along lines 3—3 of FIG. 2.

Referring to the drawings, and initially to FIG. 1, a door mat in accordance with the present invention comprises a base 20 including an upper portion having a depression 21 formed therein for a mat element 10 which includes a plate 11 (FIG. 3) engaged in the depression 21 of the base 20 and secured to the base 20 by fasteners 14 and which includes a brush member 12 secured on top of the plate 11 for cleaning the shoe soles of the users. The engagement of the plate 11 of the mat element 10 within the depression 21 of the base 20 may solidly retain the mat element 10 in place and may preventing the mat element 10 from moving laterally relative to the base 20. Referring next to FIGS. 2 and 3, the base 20 includes a recess 22 formed in the bottom portion thereof and located close to one end or to the front end 24 of the base 20. The base 20 includes one or more projections or pads 25 secured to the bottom portion thereof and located close to the other end or the rear end 26 thereof distal to the recess 22 of the base 20. When the pads 25 are made to a greater size, only one of the pads 25 is good enough to support the rear end 26 of the base 20 in place.

A sound generating device 30, such as an integrated circuit or a processing unit, includes a recorded word or sound therein, and includes a switch button 31 extended downward therefrom for engaging with the supporting surface 80. The base 20 includes one or more ears 27 extended inward of the recess 22 thereof. One or more pins 33 are slidably engaged and extended through the ears 27 respectively and each includes a pad 34 secured to the bottom for engaging with the supporting surface 80 and each includes an upper portion extended upward beyond the ear 27. A nut 35 or the like is secured to the upper end of each of the pins 33 for limiting the relative movement between the pins 33 and the ears 27 and for preventing the pins 33 from being disengaged from the ears 27 respectively. A spring 36 is engaged on each of the pins 33 and engaged between the ears 27 and the pads 34 for biasing the pads 34 downward to engage with the supporting surface 80 and for elevating and for spacing the switch button 31 of the sound generating device 30 from the supporting surface 80 (FIG. 3). Similarly, a single pin 33 is good enough to stably support the front end 24 of the base 20 in place when the pad 34 is made to a greater size.

In operation, as shown in FIG. 3, when a user steps his shoe on the mat element 10, the base 20, particularly the front end 24 of the base 20 will be depressed downward by the user. The switch button 31 of the sound generating device 30 will thus be depressed to actuate and to energize the sound generating device 30 to generate a sound or a song or a word for welcoming the guests or the users.

Accordingly, the door mat in accordance with the present invention includes a sound generating device for generating a welcoming word or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door mat comprising:

a base including a mat element provided thereon and including a bottom portion for engaging with a supporting surface, a sound generating device secured to said bottom portion of said base and including a switch button extended therefrom for engaging with said supporting surface, and means for biasing said switch button away from said supporting surface, said switch button of said sound generating device being actuated and depressed to energize said sound generating device when said base is depressed toward said supporting surface against said biasing means, wherein said bottom portion of said base includes at least one ear extended therefrom, at least one pin slidably engaged through said at least one ear and having a bottom end for engaging with said supporting surface, and means for biasing said bottom end of said at least one pin to engage with said supporting surface and to elevate and to space said switch button of said sound generating device from said supporting surface.

2. The door mat according to claim 1, wherein said mat element includes a plate and a brush member secured on said plate, and means for securing said plate of said mat element to said base.

3. The door mat according to claim 2, wherein said base includes an upper portion having a depression formed therein for receiving said plate of said mat element.

4. The door mat according to claim 1, wherein said bottom portion of said base includes a recess formed therein for receiving said sound generating device.

5. The door mat according to claim 4, wherein said base includes a first end and a second end, said first end of said base includes said recess formed in said bottom portion of said base, said second end of said base includes at least one pad secured thereon.

6. The door mat according to claim 1, wherein said at least one pin includes a pad secured to said bottom end thereof and includes an upper end extended upward beyond said at least one ear, and means for preventing said at least one pin from being disengaged from said at least one ear.

* * * * *